US006394151B1

(12) United States Patent
Donaldson et al.

(10) Patent No.: US 6,394,151 B1
(45) Date of Patent: May 28, 2002

(54) DUAL MODE PROPANE FUEL DISPENSING APPARATUS AND METHOD

(76) Inventors: Curtis J. Donaldson, 7430 N. Lakeview Dr., Salado, TX (US) 76571; Mark D. Hoebener, 704 N. 5th St., Jarral, TX (US) 76537

( * ) Notice: Subject to any disclaimer, the term of this patent is extended or adjusted under 35 U.S.C. 154(b) by 0 days.

(21) Appl. No.: 09/821,872

(22) Filed: Mar. 30, 2001

(51) Int. Cl.[7] ..... B65B 1/04

(52) U.S. Cl. ..... 141/99; 141/9; 141/83; 141/98

(58) Field of Search ..... 141/1, 2, 9, 18, 141/67, 98, 99, 100–104, 83, 94, 95

(56) References Cited

U.S. PATENT DOCUMENTS 5,427,160 A * 6/1995 Carson et al.
5,913,344 A * 6/1999 Wronski et al.
6,068,030 A * 5/2000 Tatsuno

* cited by examiner

*Primary Examiner*—Steven O. Douglas
(74) *Attorney, Agent, or Firm*—Mark Clodfelter

(57) ABSTRACT

A dual-mode propane fuel dispenser apparatus and a metal skid framework supporting a bottled gas dispensing station on one side and a motor vehicle fuel pump carried at an opposite side. Dispensing nozzles at each side are coupled to a common supply tank and solenoid valves are used to control flow to the selected dispenser. The bottled gas station has a scale to measure weight to determine when the container is full. The fuel dispenser includes a meter which determines the volume of fuel dispensed. A computer and visual displays are provided to show amounts dispensed to either a vehicle tank or bottled gas container and the price charged for each.

10 Claims, 6 Drawing Sheets

DUAL MODE PROPANE FUEL DISPENSING APPARATUS AND METHOD

FIELD OF THE INVENTION

This invention relates to dispensing of liquid petroleum gas (LPG) and more particularly to methods and apparatus for dispensing of propane gas to motor vehicle tanks and to portable bottled gas containers.

BACKGROUND OF THE INVENTION

"Propane" strictly speaking relates to a specific alkane hydrocarbon compound of the same family as methane, ethane, butane and others. Propane is a component of natural gas, and it can be separated from other components by compressing and cooling the natural gas mixture until propane becomes liquefied. Propane is also obtained as a by-product in fractional distillation of petroleum. The liquefied gas from these sources is sold commercially as bottled gas fuel distributed to customers in small portable containers and as a motor vehicle fuel used in engines adapted for this purpose.

Commercially available propane fuel is conventionally designated as "propane" despite small amounts of other gasses such as methane, ethane, butane and other hydrocarbon gasses mixed with the propane. Up to about 5% or so (in the United States) of such other components may be included. In the present application, it is to be understood that "propane" is intended to refer to commercially available fuel mixtures so designated which may include other gasses.

Although the composition of propane fuel as bottled gas and motor fuel applications may be the same in each case, the apparatus and method used in measuring the amount dispensed and determining the price to retail customers varies significantly. Bottled gas fuel is stored and transported in pressurized, portable metal cylinders which typically hold anywhere from about 2.5 pound to 100 pounds of gas. Many of the customers for bottled gas fuel are owners of recreational vehicles such as motor homes and trailers who take advantage of the convenience afforded by the portability of this fuel. Filling of bottled gas containers is generally carried out as a refilling service at a standard charge based on the amount of liquified gas needed to fill an empty tank. This type of service does not take into account residual amounts of liquid gas in the container, meaning that the customer pays more per unit of liquified gas received if the tank is not empty. Completion of filling is determined by weight, which requires the presence of a suitable scale. Propane motor fuel, on the other hand, is dispensed and sold in certain areas of the country in much the same manner as gasoline and diesel fuel, that is by dispensers installed at filling stations, the dispensers metering purchased fuel by volume and automatically displaying the price, based on gallons delivered. In many instances, propane is sold both as bottled gas and motor fuel at the same retail establishment, which may be a convenience store or filling station. Here, vehicles are typically fueled at a service island, while the bottled gas refueling facility is a separate facility some distance away from the service island. Under these circumstances, it would be advantageous to provide an integrated propane dispensing facility which would enable serving both markets and which would use, to the extent possible, the same equipment for both.

SUMMARY OF THE INVENTION

The present invention is directed to a dual purpose propane dispensing system comprising apparatus appropriate for a bottled gas dispensing station disposed in an enclosure on one side of a supporting frame and a propane motor vehicle dispenser disposed on the other side thereof or in close proximity thereto. The system is adapted for installation on a common service island of a filling station and for being connected to a propane supply line provided at the island. A scale and a pressurized dispensing nozzle coupled to the supply line are housed in the enclosure on the bottle gas side, the enclosure provided with a lock securing the nozzle when not in use. The propane motor vehicle fuel dispenser on the other side may have the same fuel delivery features as in previously known propane dispensers, but is modified to enable input data obtained from flow of bottled gas to be fed into the electronic metering and price display components of the dispenser so as to provide a display of the price for dispensed bottled gas. Flow of fuel from the supply line to the selected nozzle, either the bottled gas nozzle or the motor vehicle dispenser nozzle, may be controlled by switching of solenoid-actuated valves controlling flow to the nozzles. Price calculations made by the computer may be controlled to reflect the different tax treatment of motor vehicle fuel and bottled gas.

The dual purpose system of this invention is designed for preassembly at a factory or shop, with only the steps of bolting the supporting skid to a concrete pad of a service island, making connections to a liquid supply line, vapor lines and an electrical source being required.

This system also provides a complete retail propane refueling system at a single location, allowing bottled gas containers and motor vehicle tanks to be filled quickly and conveniently. Further advantages are provided by the rugged construction and professional appearance presented to the customer. Unlike prior practice, this approach also provides a fairer result to those seeking bottled gas by only charging for the amount of fuel delivered.

DESCRIPTION OF THE PREFERRED EMBODIMENT

Figure 1:
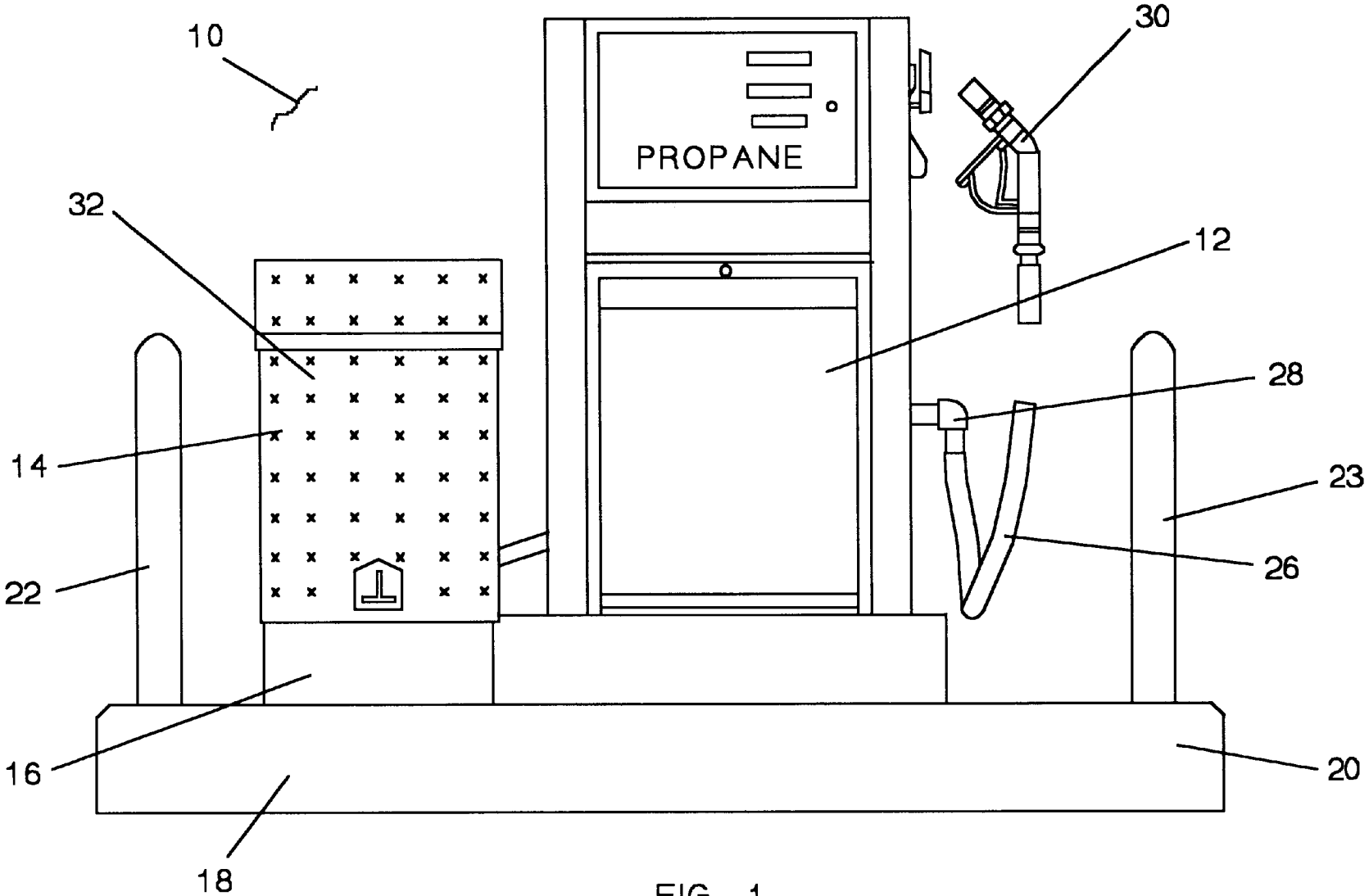
FIG. 1 is a front elevational view showing a fuel dispensing system embodying the invention with a scale enclosure thereof closed.

Referring to FIG. 1 of the drawings, there is shown a dual-mode propane dispenser system 10 comprising a motor vehicle fuel dispenser 12 and a bottled gas dispenser and scale enclosure 14 integrally constructed in side-by side relationship on a skid 16 in position on a concrete pad 18 of a service island 20. The service island extends about 6 inches or so upward from the surface of the surrounding pavement and typically has a pair of inverted U-shaped guard posts 22, 23 (or alternately a series of posts or the like) embedded therein to provide protection from being hit. Dispenser 12 has a hose 26 connected at one end to fitting 28 extending outward from the dispenser (not shown) and at the other end to a nozzle 30 from which fuel is dispensed. Fuel hose 26may or may not incorporate includes a fuel supply line and a vapor return line.

Figure 2:
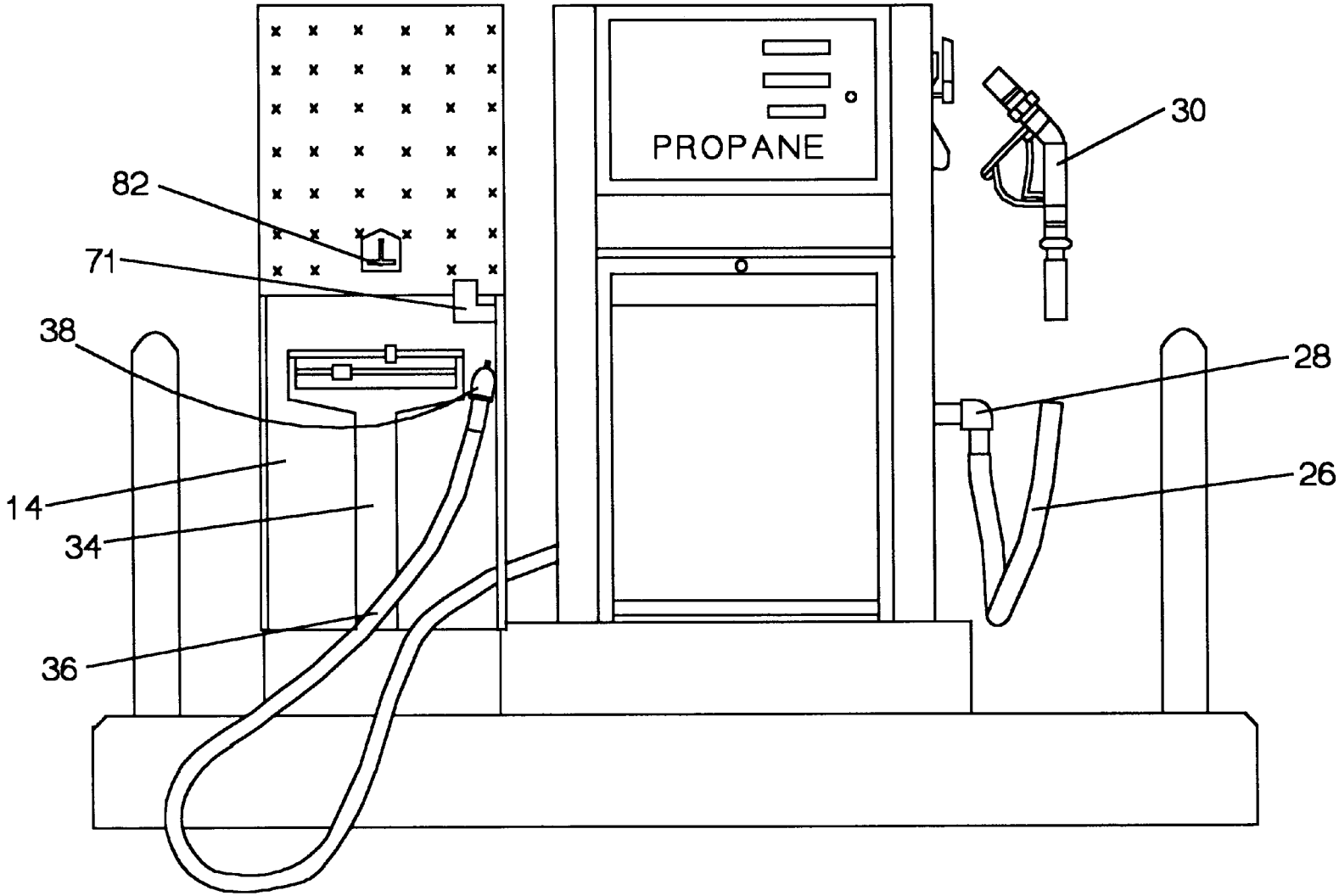
FIG. 2 is a view as in FIG. 1 with a cover of the enclosure lifted.

As shown in FIG. 2, enclosure 14, with hinged cover lifted in this view, has a platform scale 34 placed therein for weighing of bottled gas containers to determine when the container is full. Alternately, by use of suitable equipment, an electronic indication of weight may be obtained and provided to the computer for controlling flow of fuel. Fuel line 36 extends into the enclosure from assembly 12 and terminates at nozzle 38 through which bottled gas is dispensed.

Figure 3:
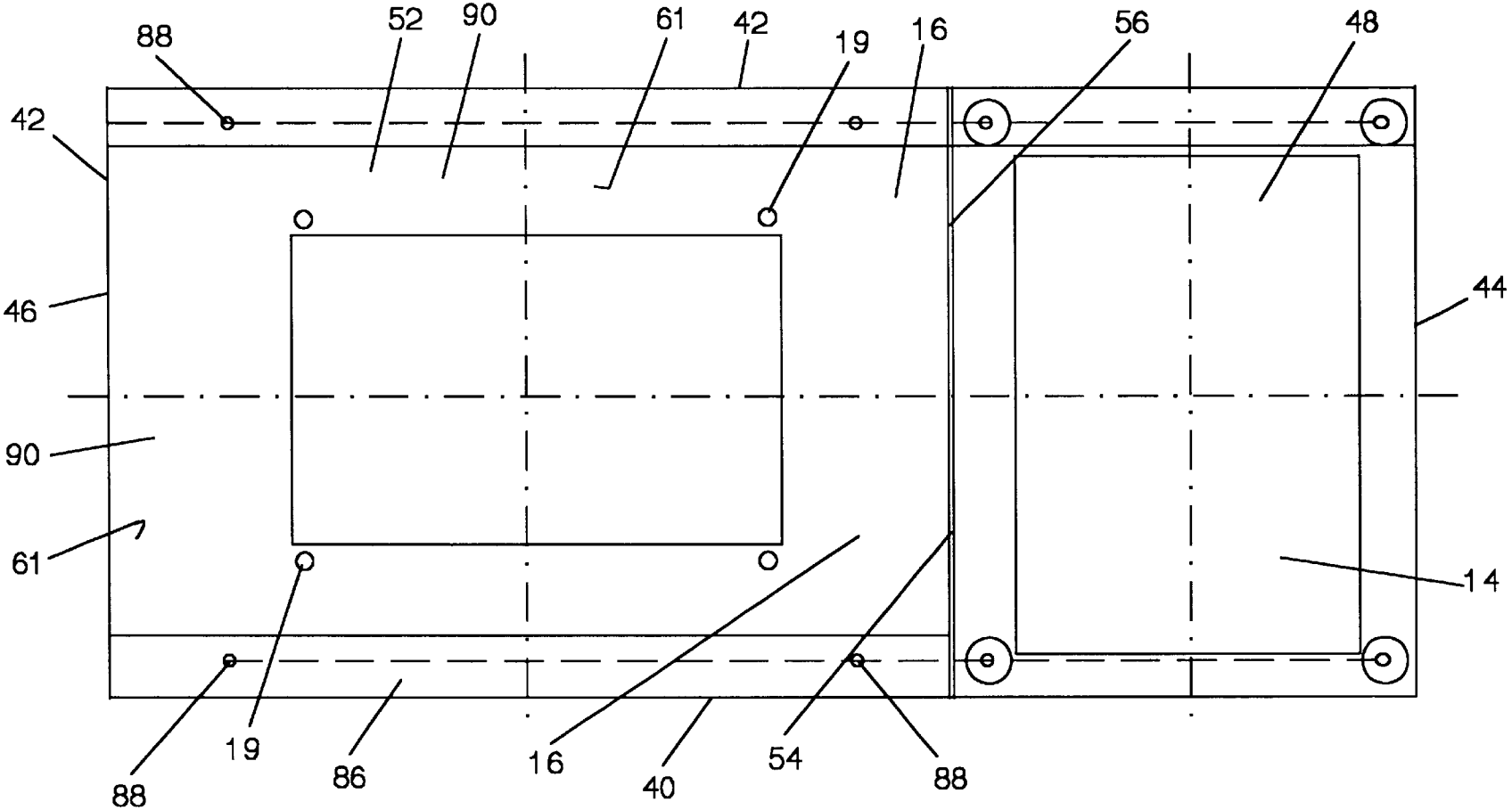
FIG. 3 is a plan view of the skid shown from below.
Figure 4:
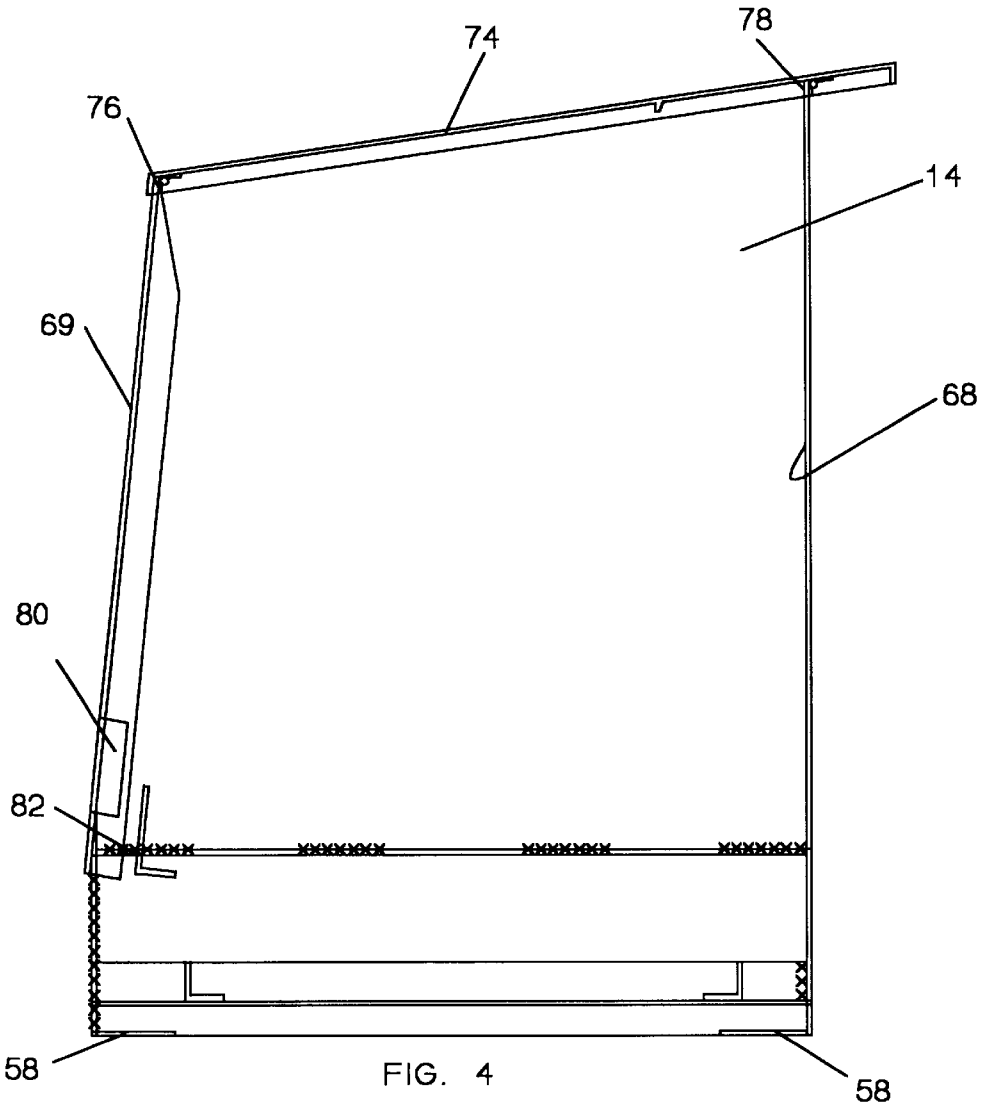
FIG. 4 is a side view of the scale enclosure, with one side removed for purposes of clarity.
Figure 5:
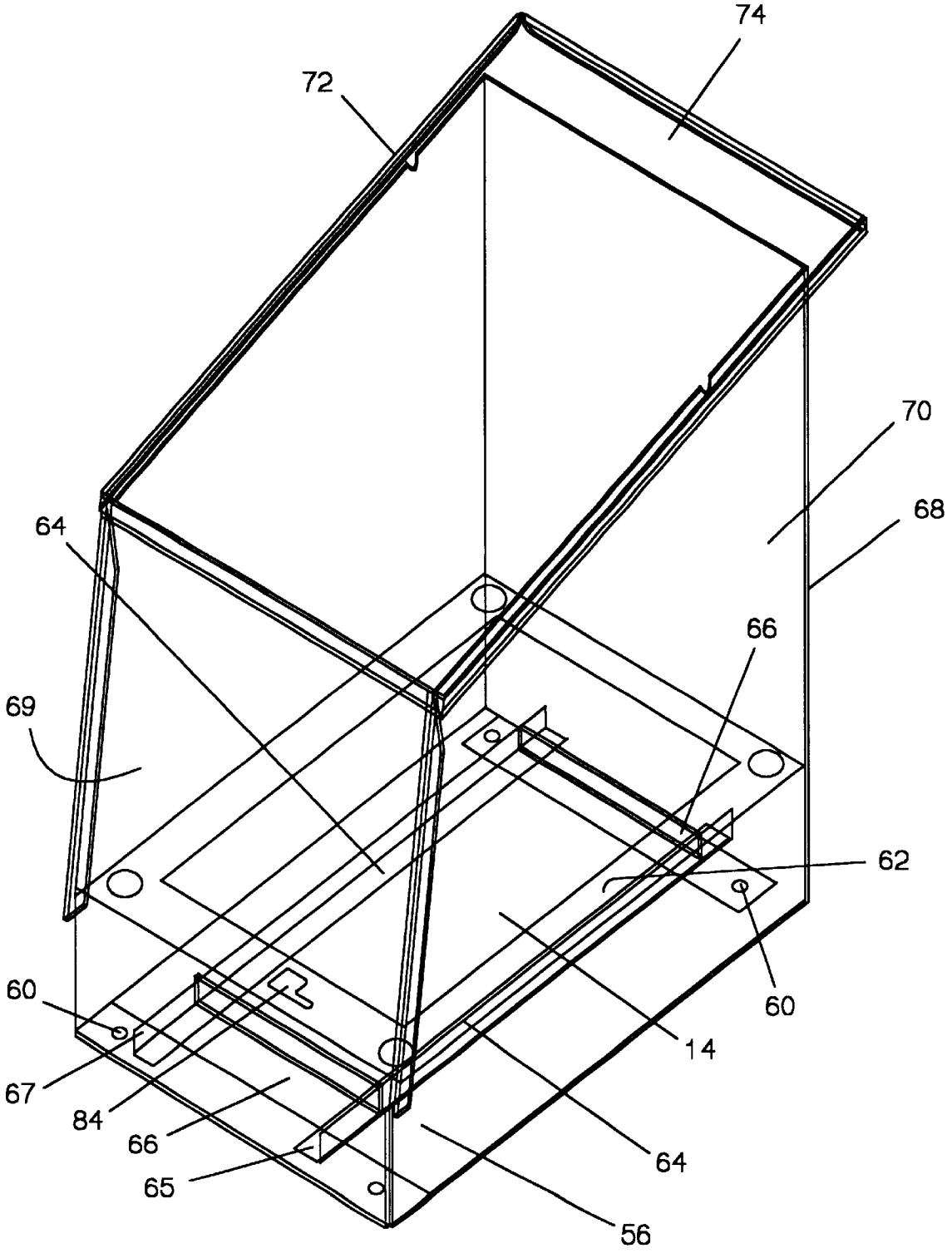
FIG. 5 is a three-dimensional view showing scale-support structure.

Skid 16 (FIGS. 3–5) comprises a rugged metal framework upon which components at the dispenser 12 and enclosure 14 may be securely connected, providing a one-piece, pre-assembled installation at a customer site. Skid 16 preferably takes the form of a rectangular framework structure having vertical side panels extending around its periphery, including panels 40, 42 along the length of the skid and panels 44, 46 across the ends thereof. The skid is divided into two portions placed in contact side by side, a first portion 48 supporting a scale and bottled gas dispenser enclosure 14 and a second portion 52 supporting a motor vehicle fuel dispenser assembly 12. Panels 54, 56 extend across the skid at the juncture of the two portions, these panels being secured together by bolts (not shown). Owing to differences in internal structure of the respective portions it is preferred to fabricate them separately and then bolt them together to obtain a one-piece skid.

Side panels of the enclosure portion each have a bent-over flange 58 (FIG. 4) at a bottom edge thereof, providing a base upon which the skid rests. The flanges are connected to pad 18 of the island by bolts (not shown) which extend through holes 60. Horizontal flange strips 61 are also provided at top edges of the skid panels at the dispenser portion of the skid.

A rectangular frame 62 (FIG. 5) is provided in enclosure portion 14 of the skid, the frame made up of two pairs of rails, one pair 64 having a L-shaped cross section extending in a direction parallel to panel 56 and a second pair of rails 66 perpendicular to rails 64. The rails may be secured to panels of the skid by having their ends connected to the panels, as by welding. One leaf 65 of the L-shaped rails is disposed parallel to the bottom edges of the skid at a distance such as one inch from the floor and the other leaf 67 is vertically disposed in position to secure a platform scale base from slipping. A platform scale is positioned with side edges of its base in close proximity to vertical portions of the rails.

Enclosure 14 has a front wall 69, a back wall 68, side walls 70, 72 and a top 74, all made of rigid metal such as a heavy aluminum plate. Bottoms of the sides and back wall are secured to top edges of panels underneath by means such as welding. Access to the scale and dispenser is enabled by mounting of the front wall 69 and top wall 74 on hinges 76, 78 located at the juncture of the top and back walls and at the juncture of the front wall and the top. Back wall 68 extends higher than front wall 69 so as to facilitate lifting the front wall up and folding it toward the rear. A catch 71 into which a lower edge of the front wall is placed extends from an internal side, and is used to hold up the front wall during filling of a propane bottle.

For providing security when the bottled gas dispenser is not in use, a lock 80 coupled to a T-handle closure 82 may be provided near the lower edge at the front wall. The lock is adapted for engagement with a mating slot 84 in the front flange strip of the skid.

Motor vehicle dispenser portion 52 of the skid has a horizontal bottom flange 86 extending around its periphery integral with vertical panels 54, 42. This flange is provided with holes 88 for securing the flange to the underlying pad 18 by means of bolts (not shown). Integral with the vertical panels a horizontal upper flange 90 extends around the same periphery providing a base member upon which the dispenser is attached. Holes 19 are provided for placement of bolts (not shown) for securing the dispenser to the skid. Knockout plugs may be provided in one or more vertical panels for introduction of a fuel supply line and wires or cables where such are not already available at a central location on the service island.

Figure 6:
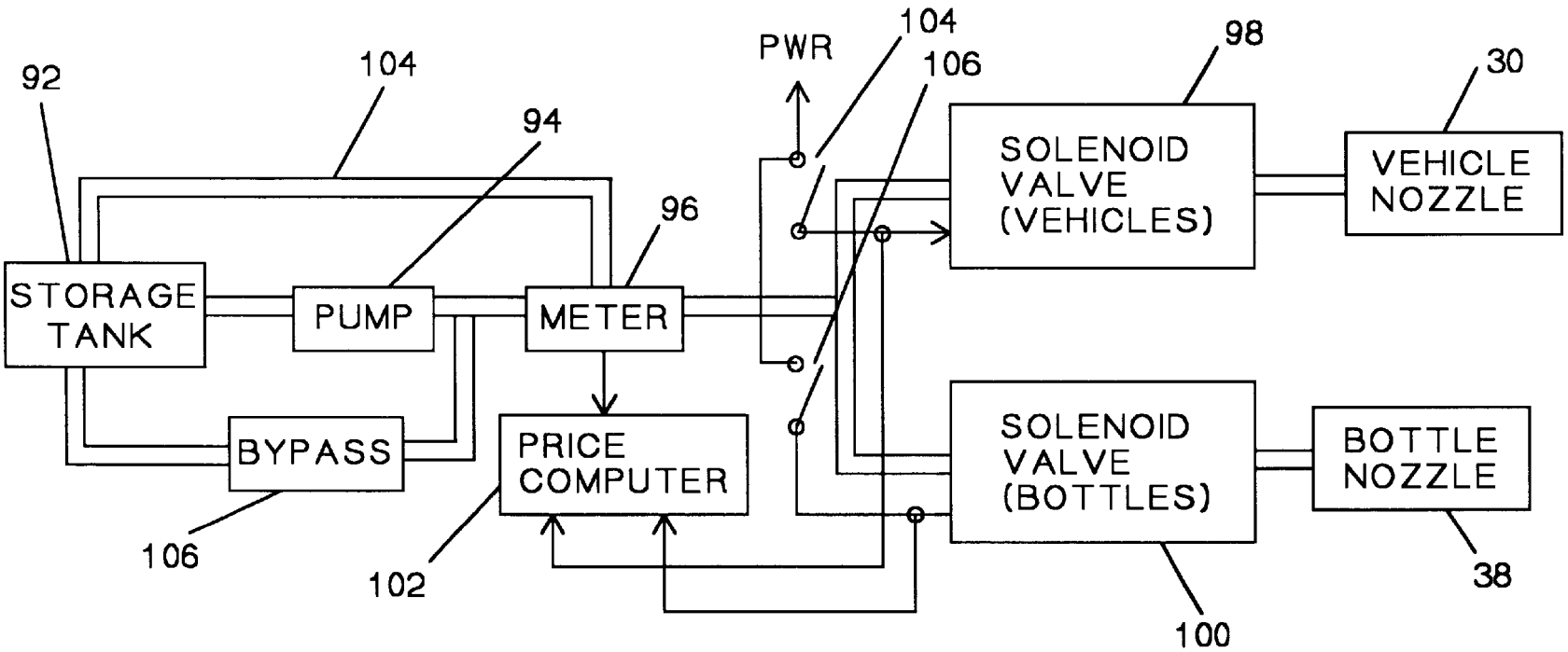
FIG. 6 is a block diagram showing control features of the apparatus.

Control features of the invention are shown schematically in FIG. 6. Storage tank 92 is connected to a pump 94 which provides pressurized flow of liquid propane fuel. Quantity of dispensed fuel is measured by meter 96, which provides electronic signals indicative of volume to the dispenser control computer. Selection of the desired delivery mode is enabled by opening solenoid valve 98 coupled to nozzle 30 by operation of switch 104 or solenoid valve 100 coupled to nozzle 38 by operation of switch 106. Data based on quantity and delivery mode is provided to price computer 102, which calculates and displays the price to be charged. A vapor return line 104 is provided to return vapor from meter 106 to the storage tank 92, and liquid bypass mechanism 106 senses excess pressure downstream of pump 94 and returns the sensed excess back to the tank.

Component equipment for apparatus of this invention may comprise commercially available pumps, nozzles, scales and the like. Motor vehicle pump assemblies which may be used are available from SQUIBB-TAYLOR, Inc. at 10480 Shady Trail, #106, Dallas, Tex. Suitable nozzles that provide temperature compensation and control of operating pressure are available from LG EQUIPMENT, Unit #29, 58 Box Road, Taren Point, New South Wales, Australia. A computerized flow control and price calculator provided by the KRAUSE GROUP, Inc., at 25 Paquin Rd, Winnipeg, Mannatoba, Canada, may be used, and which calculates price information from data obtained from a flow meter obtainable from LIQUA-TECH located at 3501 North State Street, Ukiah, Calif.

It is to be understood that the invention is not to be construed as limited to the aforementioned embodiments described, but is limited only by the following appended claims, wherein We claim:

1. Apparatus for delivering liquid propane fuel to a selected one of two types of fuel receptacles consisting of bottled gas containers and motor vehicle fuel tank at a common location and for determining a price to be charged for fuel delivered to each said receptacle comprising:

a metal framework skid having defined therein a first support portion including rails adapted for receiving and supporting a scale for determining completion of filling a bottled gas container and having associated therewith a first fuel dispensing nozzle, and a second portion adjacent to said first portion, said second portion provided with a horizontal support member adapted to have connected thereto a motor vehicle fuel dispenser placed thereon, said assembly including a second fuel dispensing nozzle;

a fuel delivery line coupled to a supply tank at a first end thereof and to a selected one of said nozzles at a second end thereof, whereby fuel may be dispensed into a bottled gas container or a motor vehicle fuel tank, depending on the nozzle selected;

said first portion further including an enclosure removably extending over and around said scale and said nozzle to secure same when not in use; and, said motor vehicle fuel dispenser including means for metering volume amount of fuel dispensed by said second nozzle, computing a price to be charged, and displaying a said volume and price values and further including means for calculating and displaying price values for amounts dispensed by said first nozzle.

2. The apparatus as defined in claim 1 wherein said second of said fuel delivery line includes a first, branched line coupled to said first nozzle and a second, branched line coupled to said second nozzle and each said branched line including a closure valve.

3. The apparatus as defined in claim 2 wherein said valves are solenoid actuated valves.

4. The apparatus as defined in claim 1 wherein said skid comprises a rectangular metal frame having vertically extending narrow panels defining a an outer periphery and a pair of panels extend across said skid at a juncture between said first and said second portions.

5. The apparatus as defined in claim 4 wherein said panels at bottom edges thereof include horizontally extending ledges providing a base upon which said skid is supported.

6. The apparatus as defined in claim 5 wherein said panels defining said second portion at top edges thereof include inwardly disposed flanges upon which a motor vehicle fuel dispenser is supported.

7. The apparatus as defined in claim 1 wherein said enclosure comprises a pair of fixed side walls and a fixed rear wall.

8. The apparatus as defined in claim 7 wherein said enclosure comprises a top wall having a forward edge and a rearward edge and a forward wall having a top edge and a bottom edge and said rearward edge of said top wall hingably connected to a top edge of said rear wall and said top edge of said forward wall is hingably connected to said forward edge of said top wall.

9. The apparatus as defined in claim 1 wherein said scale is a platform scale.

10. A method of dispensing liquid propane fuel to a bottled gas container and a motor vehicle fuel tank at a common location, measuring the amount of fuel dispensed and displaying a calculated price therefor which comprises:

providing a skid having a first portion supporting a bottled gas dispensing station including a scale, a dispensing nozzle coupled to a fuel supply tank and, a second portion supporting a motor vehicle fuel dispenser coupled to said supply tank;

selecting said bottled gas dispenser or said motor vehicle fuel dispenser to receive fuel and providing access of the selected dispenser to said supply tank;

dispensing fuel into said bottled gas container or into said motor vehicle fuel tank;

calculating a quantity of fuel dispensed; and, displaying said quantity and said price charged therefor.

* * * * *